US006778802B2

(12) United States Patent
Kabata et al.

(10) Patent No.: US 6,778,802 B2
(45) Date of Patent: Aug. 17, 2004

(54) IMAGE TRANSFERRING AND SHEET SEPARATING DEVICE AND IMAGE FORMING APPARATUS INCLUDING THE SAME

(75) Inventors: Toshiyuki Kabata, Kanagawa (JP); Hirokazu Ishii, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/391,625

(22) Filed: Mar. 20, 2003

(65) Prior Publication Data

US 2003/0219296 A1 Nov. 27, 2003

(30) Foreign Application Priority Data

Mar. 20, 2002 (JP) ..... 2002-078990
Apr. 8, 2002 (JP) ..... 2002-105738

(51) Int. Cl.[7] ..... G03G 15/16
(52) U.S. Cl. ..... 399/303; 399/313; 430/126
(58) Field of Search ..... 399/313, 303, 399/302, 308, 297; 430/126

(56) References Cited

U.S. PATENT DOCUMENTS

| | | | | |
|---|---|---|---|---|
| 5,348,818 | A | 9/1994 | Asami et al. | 429/213 |
| 5,436,092 | A | 7/1995 | Ohtsuka et al. | 429/218.1 |
| 5,437,943 | A | 8/1995 | Fujii et al. | 429/312 |
| 5,461,461 | A | 10/1995 | Harasawa et al. | 399/66 |
| 5,495,317 | A | 2/1996 | Matsuda et al. | 399/66 |
| 5,515,146 | A | 5/1996 | Harasawa et al. | 399/310 |
| 5,557,384 | A | 9/1996 | Takano et al. | 399/313 |
| 5,631,725 | A | 5/1997 | Harasawa et al. | 399/66 |
| 5,640,660 | A | 6/1997 | Takano et al. | 399/313 |
| 5,659,843 | A | 8/1997 | Takano et al. | 399/66 |
| 5,666,622 | A | 9/1997 | Harasawa et al. | 399/313 |
| 5,812,919 | A | 9/1998 | Takano et al. | 399/312 |
| 5,822,667 | A | 10/1998 | Hayama et al. | 399/314 |
| 5,885,733 | A | 3/1999 | Ohsawa et al. | 429/309 |
| 5,897,241 | A | 4/1999 | Takano et al. | 399/162 |
| 5,900,336 | A | 5/1999 | Kabata et al. | 429/231.4 |
| 5,930,573 | A | 7/1999 | Miyamoto et al. | 399/310 |
| 5,978,617 | A | 11/1999 | Takano et al. | 399/61 |
| 6,013,393 | A | 1/2000 | Taniuchi et al. | 429/303 |
| 6,188,862 | B1 | 2/2001 | Ishii | 399/313 |
| 6,282,386 | B1 | 8/2001 | Ishii | 399/66 |
| 6,521,388 | B2 | 2/2003 | Kabata et al. | 430/60 |
| 6,534,227 | B2 | 3/2003 | Kabata et al. | 430/30 |
| 2003/0035660 | A1 * | 2/2003 | Sugino et al. | 399/302 X |
| 2004/0009420 | A1 * | 1/2004 | Sugahara et al. | 430/108.1 |

FOREIGN PATENT DOCUMENTS

| | | | |
|---|---|---|---|
| JP | 9-34163 | | 2/1997 |
| JP | 9-90781 | | 4/1997 |
| JP | 10-193469 | * | 7/1998 |
| JP | 11-30918 | | 2/1999 |
| JP | 11-352787 | | 12/1999 |
| JP | 2000-255817 | * | 9/2000 |
| JP | 2000-347512 | * | 12/2000 |
| JP | 2001-122417 | | 5/2001 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image transferring and sheet separating device of the present invention includes a belt facing an image carrier. The belt conveys a sheet via a nip between it and the image carrier to thereby transfer a toner image formed on the image carrier to the sheet by being applied with a bias and then separates the sheet from the sheet. The belt contains a filler having a grain size of 0.5% to 5% of the thickness of said belt. The belt is driven with circumferential length 1% to 7% greater than circumferential length in an unloaded condition.

18 Claims, 6 Drawing Sheets

IMAGE TRANSFERRING AND SHEET SEPARATING DEVICE AND IMAGE FORMING APPARATUS INCLUDING THE SAME

BACKGROUND OF THE INVENTION

1. Field of the Invention

The present invention relates to a copier, facsimile apparatus, printer or similar electrophotographic image forming apparatus. More particularly, the present invention relates to an image transferring and sheet conveying device including a belt configured to convey a sheet or recording medium via a nip between it and an image carrier to thereby transfer a toner image from the image carrier to the sheet.

2. Description of the Background Art

Generally, in an electrophotographic image forming apparatus, after the surface of a photoconductive drum or image carrier has been charged, an exposing device directly exposes the surface of the drum or laser optics or LED (Light Emitting Diode) optics optically scans it in accordance with image data, thereby forming a latent image. A developing unit develops the latent image with toner to thereby produce a corresponding toner image. The toner image is transferred from the drum to a sheet or recording medium and then fixed by a fixing unit.

An image forming apparatus of the type described usually includes an image transferring and sheet separating device including a belt and configured to transfer the toner image from the drum to the sheet, then separate the sheet from the drum, and then covey it to the fixing unit. The belt, which is endless and faces the drum, is formed of rubber or similar elastic material and passed over a plurality of rollers including a drive roller, a driven roller and a bias roller for image transfer. The belt conveys the sheet via a nip between it and the drum while causing the toner image to be electrostatically transferred from the drum to the sheet. After the image transfer, the belt separates the sheet from the drum and conveys it to the fixing unit. A cleaning blade, cleaning brush or similar cleaning member faces at least one of the plurality of rollers via the belt in order to remove toner, paper dust and other impurities deposited on the belt.

Today, to meet the increasing demand for higher image forming speed, it is necessary to increase the linear velocity of the belt. In this case, a bias for image transfer must be lowered in order to guarantee expected image transfer. However, a bias of, e.g., 1,000V produces ozone and oxide gases including NOx (nitrogen oxides) during image transfer; the lower the bias, the greater the amount of oxide gases. Polychloroprene rubber is contained in many of conventional belts as a major component from the processing, durability and cost standpoint. However, because polychloroprene rubber is not sufficiently resistant to oxide gases, the belt cracks as image formation is repeated with a high bias for image transfer, resulting in defective image transfer and therefore defective images. The belt should therefore be frequency replaced.

The belt critically lowers image quality when slackened at the position where it faces the drum. In light of this, it is a common practice to stretch the belt during operation, compared to an unloaded condition. However, when the belt is continuously stretched during high-speed movement, the belt slackens or cracks as image formation is repeated and critically lowers image quality. The belt therefore should be frequency replaced.

A filler, e.g., carbon black or similar carbon or silica, alumina, talc or similar inorganic compound is, in many cases contained in the belt in order to improve the mechanical and electric characteristics of the belt. Considering the dispersion of the filler, the grain size of the filler should preferably be as small as possible. However, if the grain size is excessively small, then the mechanical and electric characteristics cannot be improved as expected, so that the filler content of the belt should be increased. This reduces the flexibility of the belt and renders the electric characteristics of the belt irregular and thereby causes the belt to easily crack due to repeated image formation while rendering image transfer irregular as well.

If the grain size of the filler is excessively great, the filler cannot be uniformly dispersed in the belt and makes the mechanical and electric characteristics of the belt locally irregular. This also results in cracks and irregular image transfer.

Even though the belt may be provided with a persecuted composition, any change in the thickness or the circumferential length of the belt directly translates into a change in, among others, the durability of the belt, making the above composition useless in many cases. A new composition must therefore be studied by trial and error. This is particularly true when the thickness of the belt is changed.

Further, to meet the increasing demand for size reduction of the image forming apparatus, it is necessary to reduce the size of the image transferring and sheet conveying device as well. The size of this device may be reduced if, e.g., diameters of the rollers over which the belt is passed are reduced. However, if the roller diameter is reduced to, e.g., 20 mm or below, heavy stress acts on the belt due to curvature and noticeably reduces the life of the belt up to the appearance of cracks.

The protection of rubber from deterioration ascribable to ozone and other oxide gases has long been a target to tackle in the rubber industry. For example, it has been customary to add an anti-deterioration agent, which reacts with ozone and inactivates it, to rubber or to coat it on the surface of rubber. Typical of the anti-deterioration agent are an amine-ketone condensate, aromatic secondary amine or similar amine-containing agent, a monophenol derivative, polyphenol derivative, hydroquinone derivative or similar phenol-containing derivative, a sulfur-containing agent, and a phosphor-containing agent. However, the anti-deterioration agent practically looses the expected effect when fully reacted with ozone. This, coupled with the limited allowable content of such an agent, makes it impossible to sufficiently extend the life of the belt. Particularly, when the bias for image transfer is −1,000 V or below, the life of the belt is short because of a great amount of ozone produced.

It has also bee customary to cope with the deterioration of rubber by adding, e.g., wax to rubber in order to physically isolate rubber from ozone by using the blooming of wax. However, although the wax-containing belt is highly resistant to ozone, the belt is apt to locally stretch or crack due to the low melting point of wax during repeated image formation, resulting in defective image transfer or defective sheet separation.

Technologies relating to the present invention are disclosed in, e.g., Japanese Patent Laid-Open Publication Nos. 9-34163, 9-90781, 11-30918, 11-352787 and 2001-122417.

SUMMARY OF THE INVENTION

It is an object of the present invention to provide an image transferring and sheet separating device insuring desirable image transfer and sheet separation over a long time without its belt being replaced, and an image forming apparatus including the same.

It is another object of the present invention to provide an image transferring and sheet separating device implementing high image forming speed and size reduction, and an image forming apparatus including the same.

An image transferring and sheet separating device of the present invention includes a belt facing an image carrier. The belt conveys a sheet via a nip between it and the image carrier to thereby transfer a toner image formed on the image carrier to the sheet by being applied with a bias and then separates the sheet from the sheet. The belt contains a filler having a grain size of 0.5% to 5% of the thickness of said belt. The belt is driven with circumferential length 1% to 7% greater than circumferential length in an unloaded condition.

An image forming apparatus including the above image transferring and sheet conveying device is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
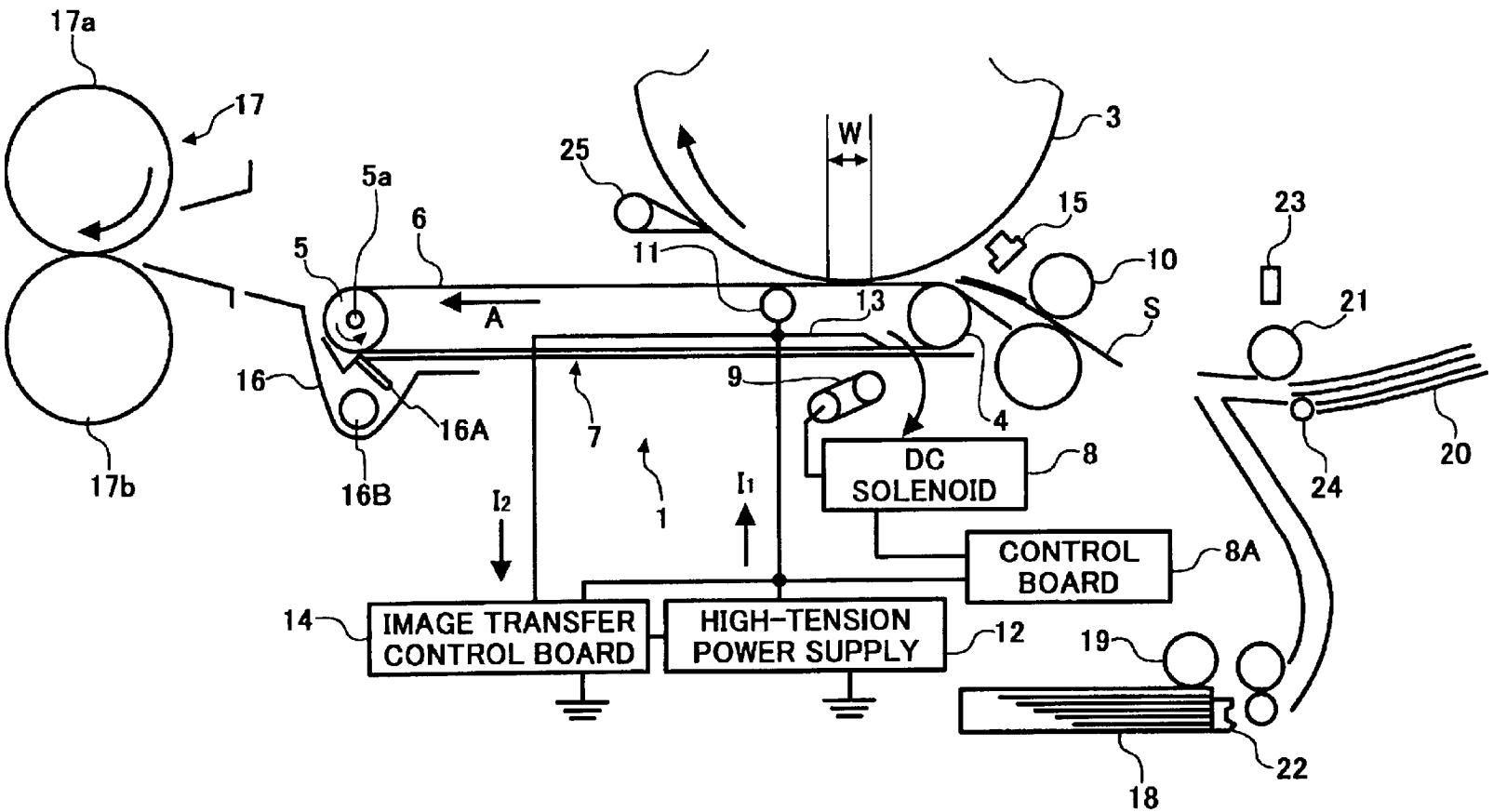
FIG. 1 shows an image forming apparatus with which preferred embodiments of the present invention are practicable in a condition before image transfer.
Figure 2:
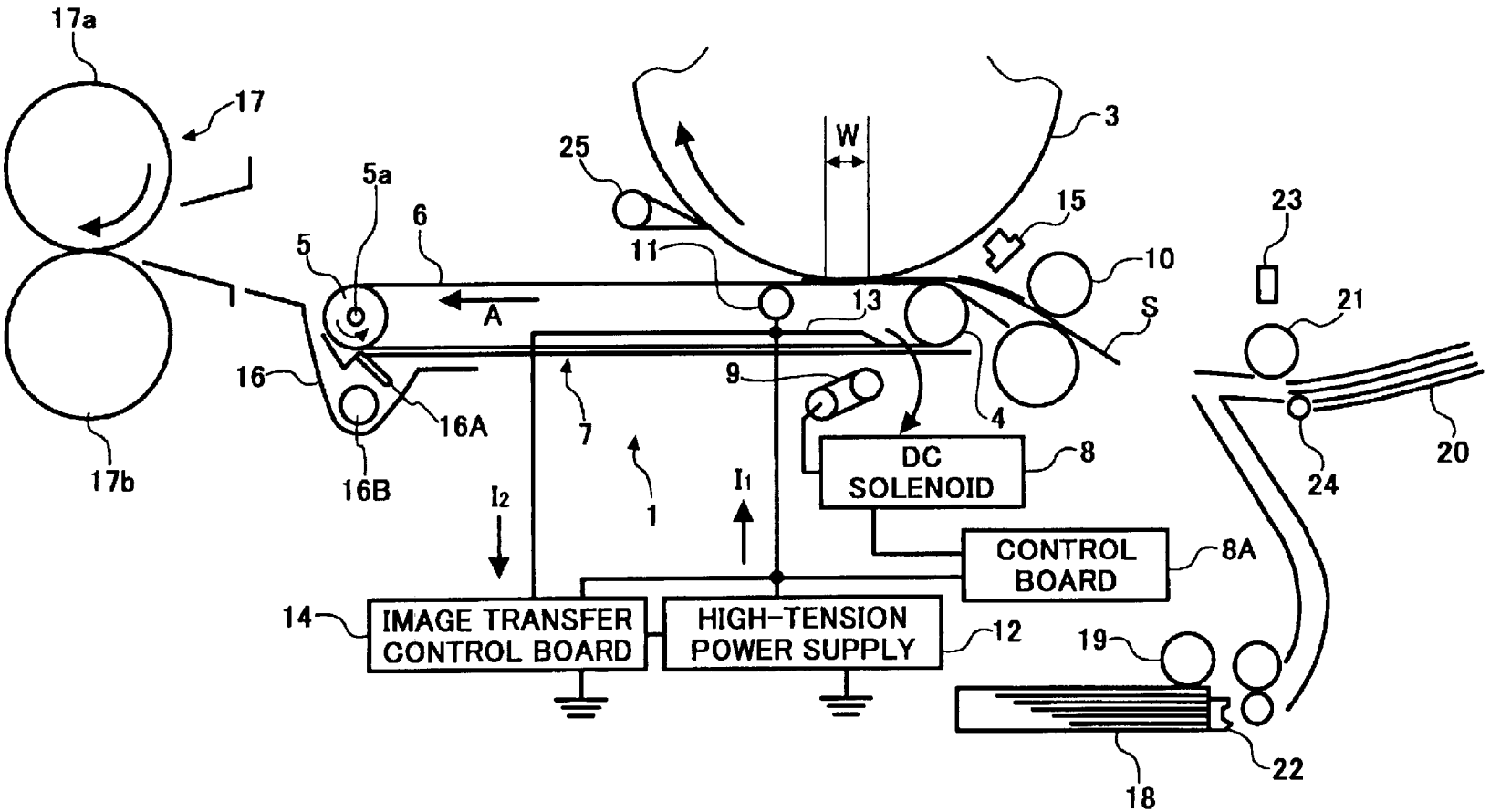
FIG. 2 is a view similar to FIG. 1, showing the apparatus in a condition during image transfer.
Figure 3:
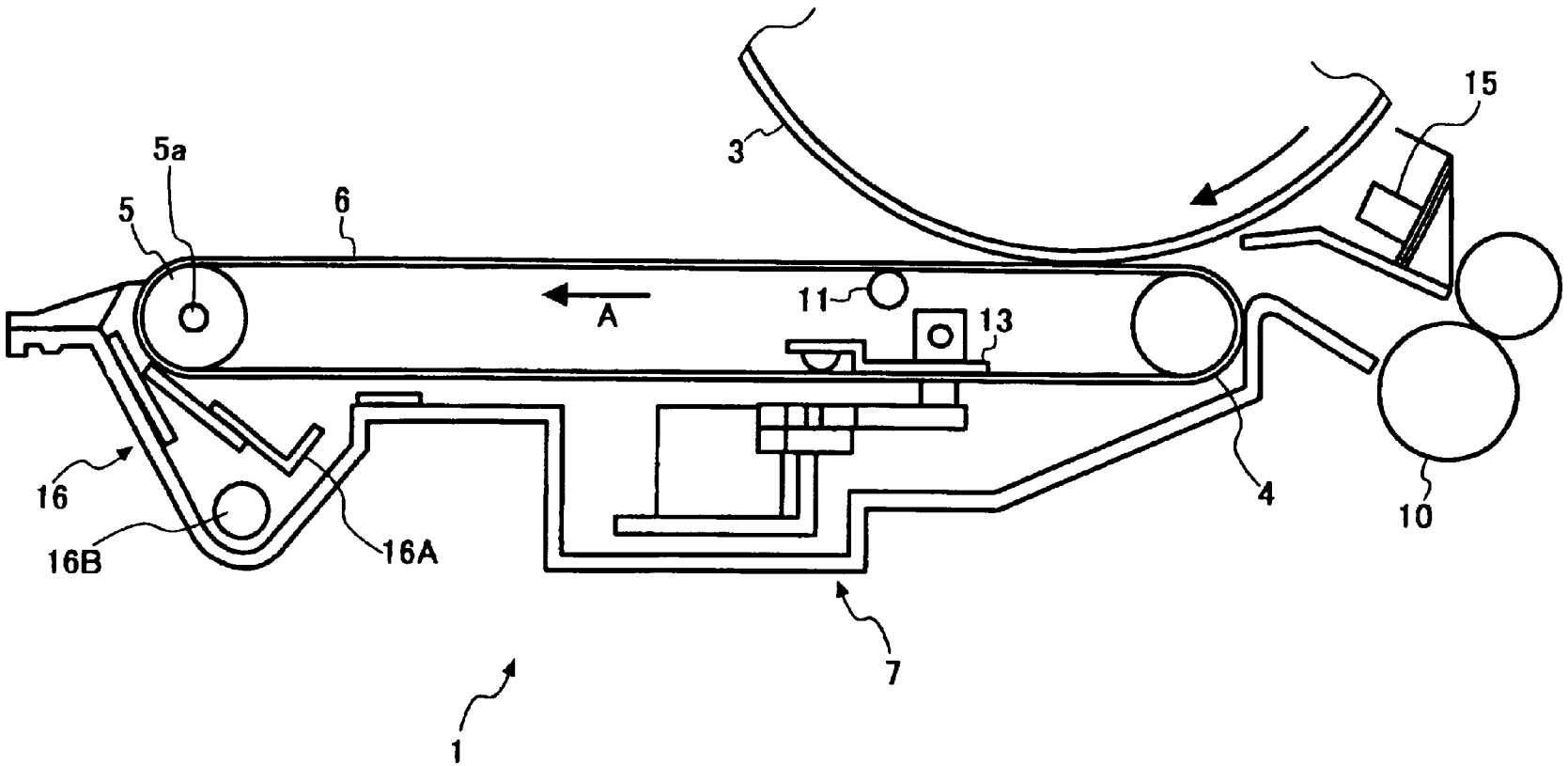
FIG. 3 is a section showing a belt included in the apparatus together with arrangements around the belt.

Referring to FIGS. 1 and 2 of the drawings, an image forming apparatus including an image transferring and sheet separating device embodying the present invention is shown. As shown, the image transferring and sheet separating device, generally 1, includes an endless belt 6. FIGS. 1 and 2 show a condition before image transfer and a condition during image transfer, respectively. FIG. 3 shows arrangements around the belt 6 more specifically.

As shown in FIGS. 1 through 3, the image forming apparatus includes a photoconductive drum or image carrier 3. The image transferring and sheet separating device 1 adjoins the drum 3. Arranged around the drum are a charger, an exposing unit or an optical writing unit using a laser diode or an LED (Light Emitting Diode) array, a developing unit, a cleaning unit, a quenching lamp and other conventional devices for electrophotographic image formation, although not shown specifically. For color image formation, an intermediate image transfer body implemented as a belt or a drum may be positioned between the drum 3 and the belt 6.

An image transfer bias of −1,000 V or below is essential for increasing image forming speed, but produces ozone and oxide gases including NOx. It is therefore necessary to enhance the durability, i.e., mechanical strength and uniform composition of the belt 6. In light of this, we conducted a series of experiments and found the following. The optimum range of the grain size of a filler varies with the thickness of the belt 6. Particularly, when the belt 6 is used with a circumferential length stretched by 1% to 7%, compared to a circumferential length in an unloaded condition, high-quality images are achievable even after repeated image formation without the replacement of the belt 6 if a filler whose grain size is 0.5% to 5% of the thickness of the belt 6 is contained in the belt 6.

More specifically, the grain size of a filler contained in the belt 6 must be varied in accordance with the thickness of the belt 6. When the grain size of the filler is 0.5% to 5.0%, preferably 0.7% to 4.5% or more preferably 1.0% to 4.0%, of the thickness of the belt 6, the belt 6 achieves desirable mechanical characteristics, uniform electric characteristics, and long life. A grain size below 0.5% does not noticeably contribute to the enhancement of the mechanical characteristics of the belt 6. A grain size above 5% is apt to make the electric and mechanical characteristics non-uniform; particularly, such a grain size causes cracks to start at the filler.

When the circumferential length of the belt 6 is greater during operation than during an unloaded condition by 1.0% to 7.0%, preferably 1.5% to 6.0% or more preferably 2.0% to 5.0%, image quality is high while the life of the belt 6 is extended because the belt 6 is note deteriorated even after repeated image formation. When the stretch of the belt 6 is less than 1.0%, part of the belt 6 facing the drum 3 is apt to loose flatness and cause the drive-of the belt 6 irregular, lowering image quality. When the stretch of the belt 6 is above 7.0%, heavy mechanical stress acts on the belt 6 and accelerates the deterioration of the belt 6 while increasing the tension of the belt 6. An increase in the tension of the belt 6 results in the need for a drive roller having a large diameter.

The filler with the grain size of 0.5% to 5% of the thickness of the belt 6 may be any one of chalk, heavy calcium carbonate or similar natural calcium carbonate, light calcium carbonate, pulverized calcium carbonate or similar synthetic calcium carbonate, caolin, baked clay, bentonite, zeolite, talc or similar natural silicate, synthetic aluminum silicate, synthetic calcium silicate or similar synthetic silicic acid, water-containing silicate, silicic acid anhydride or similar synthetic silicic acid, basic magnesium carbonate or similar magnesium carbonate, aluminum hydrate, magnesium oxide, aluminum oxide, titanium oxide, indium oxide, barium sulfide, calcium sulfide or similar inorganic compound. Among them, natural silicates, synthetic silicates, natural silicic acids, synthetic silicic acids and other silicon-containing compounds are preferable because they react with oxide gases little, remain stable against aging, and enhance the mechanical strength of the filler itself as well as dispersion. Particularly, synthetic silicic acids are excellent as to dispersion and improvement of mechanical strength.

The filler having the grain size of 0.5% to 5% of the thickness of the belt 6 is contained in the belt 6 in an amount of 5 wt % to 25 wt %, preferably 6 wt % to 23 wt % or more preferably 7 wt % to 20 wt %, of the entire belt 6. An amount below 5 wt % makes hardly any contribution to the improvement of the mechanical characteristics, limiting the life of the belt 6. An amount above 25 wt % lowers the flexibility of the belt 6 and is apt to cause the filler to come off from the belt 6, resulting in cracks.

A filler other than the filler whose grain size is 0.5% to 5% of the thickness of the belt 6 may additionally be contained in the belt 6. However, a filler with a grain size greater than 5% of the thickness of the belt 6 is apt to cause cracks to start at the filler. It follows that the content of such a filler should be 3 wt % or below, preferably 1 wt % or below or more preferably 0.5 wt % or below, of the entire belt 6.

On the other hand, a filler with a grain size which is smaller than 0.5% of the thickness of the belt 6 is desirable from the uniform electric and mechanical characteristics standpoint, particularly when high-resolution images are desired. For the filler with such a grain size, use maybe made of any one of acetylene black, carbon black and other carbons in addition to the previously mentioned fillers. Among them, carbons are particularly desirable in providing the belt 6 with conductivity and improving the mechanical characteristics of the belt 6. The grain size of the filler smaller than 0.5% of the thickness of the belt 6 should preferably be between 0.005% and 0.5%, more preferably between 0.005% and 0.4% or even more preferably between 0.01% and 0.3%. A filler whose grain size is less than 0.005% of the thickness of the belt 6 improves the electric and mechanical strengths of the belt 6 little.

The content of the filler whose grain size is less than 0.5% of the thickness of the belt 6 should be between 5 wt % and 25 wt %, preferably between 6 wt % and 20 wt % or more preferably between 7 wt % and 18 wt %, of the entire belt 6. A content below 5 wt % makes hardly any contribution to the uniform mechanical and electric characteristics. A content above 25 wt % is apt to cause the filler to come off from the belt 6 and make the mechanical and electric characteristics irregular, resulting in low image quality.

In the illustrative embodiment, the thickness of the belt 6 should be between 200 $\mu$m and 2,000 $\mu$m, preferably between 300 $\mu$m and 800 $\mu$m or more preferably between 400 $\mu$m and 700 $\mu$m, although it may be suitably selected in matching relation to image forming speed, the thickness and material of a recording medium, belt 6 and so forth. Thickness below 200 $\mu$m makes the strength of the belt 6 short and is apt to cause the belt 6 to be scratched, thereby lowering image quality. Thickness above 1,000 $\mu$m increases mechanical stress to act on the belt 6 due to curvature, so that the diameter of the drive roller must be increased, rendering the entire apparatus bulky. Further, thickness above 1,000 $\mu$m aggravates irregularity in the resistance of the belt 6 to thereby lower image quality.

The operation of the illustrative embodiment will be described with reference to FIGS. 1 through 3 hereinafter. On the start of an image forming cycle, a drive section, not shown, causes the drum 3 to rotate while the charger uniformly charges the surface of the drum 3. The exposing unit or the optical writing unit exposes the charged surface of the drum 3 imagewise to thereby form a latent image. The developing unit develops the latent image with a developer for thereby producing a corresponding toner image. A pickup roller 19 pays out a sheet or recording medium S from a tray or sheet feeding device 18 toward a registration roller 10 in synchronism with the image forming operation. Alternatively, the sheet S may be fed from a manual feed tray 20 to the registration roller 10 by a pickup roller 21. At this instant, sheet size sensing means 22 or 23 senses the size of the sheet S at least in the direction perpendicular to the direction of sheet conveyance. The manual feed tray 20 is foldable about a shaft 24.

The registration roller 10 once stops the sheet S and then conveys it such that its leading edge meets the leading edge of the toner image carried on the drum 3. After the development of the latent image, a pretransfer quenching lamp 15 illuminates the drum 3 to thereby lower the surface potential of the drum 3. Subsequently, the belt 6 conveys the sheet S via a nip W between the drum 3 and the belt 6, so that the toner image is transferred from the drum 3 to the sheet S. Subsequently, a peeler 25 peels off the sheet S from the drum 3. The belt 6 then conveys the sheet S to a fixing unit 17, so that the toner image is fixed on the sheet S by the fixing unit 17. After the image transfer, the cleaning unit removes toner left on the drum 3, and then a discharger discharges the surface of the drum.

Figure 4:
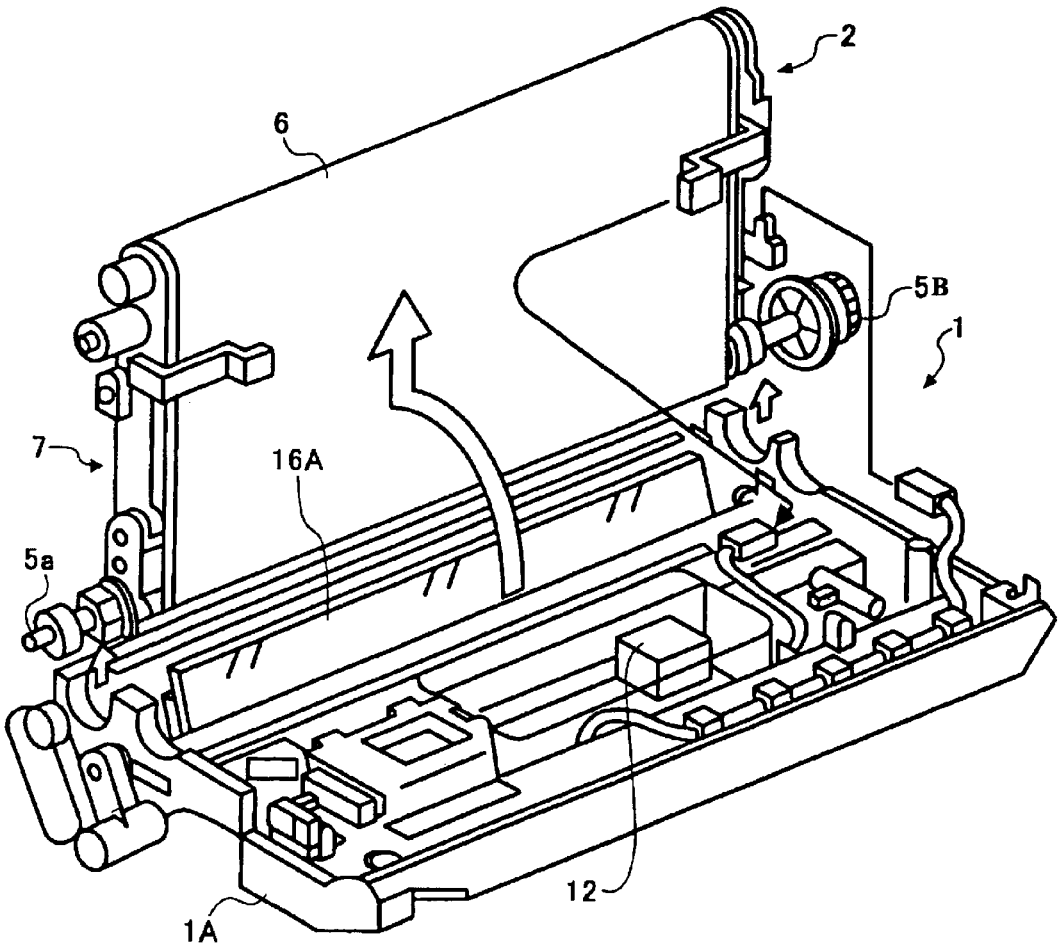
FIG. 4 is an isometric view showing a specific configuration of an image transferring and sheet separating device included in the apparatus.

FIG. 4 shows a specific configuration of the image transferring and sheet separating device 1 including the belt 6. As shown, a belt unit 2 is removably mounted on a body 1A. As shown in FIGS. 1 through 3, the belt unit 2 includes the belt 6 passed over a pair of rollers 4 and 5, a DC solenoid 8 and a lever 9 for moving the belt 6 into or out of contact with the drum 3, a bias roller 11 for applying a bias to the belt 6, and a contact plate 13 for discharging the belt 6. A belt cleaning unit 16 includes a cleaning blade 16A for scraping off toner and paper dust deposited on the belt 6. The belt cleaning unit 16 and a high-tension power supply 12, which applies a voltage to the bias roller 11, are mounted on the body 1A, FIG. 4.

Figure 5:
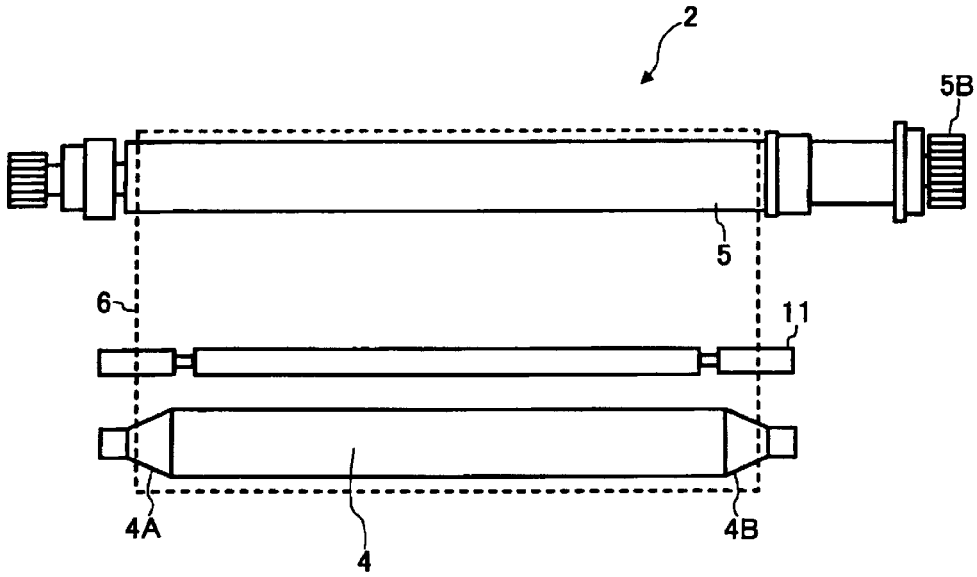
FIG. 5 shows rollers over which the belt is passed.
Figure 6:
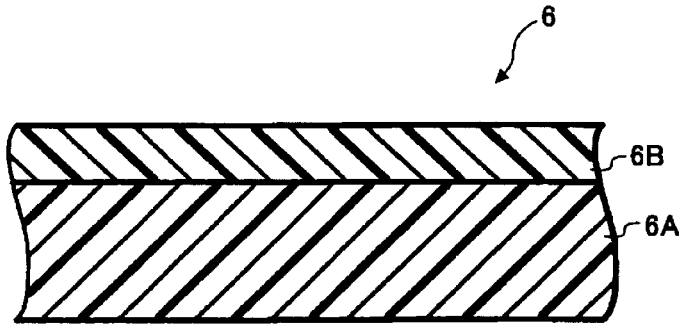
FIG. 6 is a section showing the belt.

As shown in FIGS. 4 and 5, the roller 5 includes a gear SB operatively connected to a motor not shown. The roller or drive roller 5 causes the belt 6 to move in a direction indicated by an arrow A in FIG. 1 (direction of sheet feed) via the nip between the belt 6 and the drum 3. As shown in FIG. 6, the belt 6 is a laminate of two layers or three or more layers, if desired. When DC 100 V is applied, an outer layer or lubrication layer 6B forming part of the belt 6 has surface resistivity of $1\times10^{9}$ Ω to $1\times10^{12}$ Ω an inner layer 6A forming the other part of the belt 6 has surface resistivity of $1\times10^{7}$ Ω to $1\times10^{9}$ Ω, and the volume resistivity of the belt 6 is $5\times10^{11}$ Ω·cm to $5\times10^{10}$ Ω·cm, as measured in accordance with JIS (Japanese Industrial Standards) K6911 scale.

As shown in FIGS. 1 and 4, the rollers 4 and 5 are rotatably supported by a support member 7. The support member 7 is angularly movable about the support shaft 5*a* of the roller 5 positioned downstream of the nip between the drum 3 and the belt 6 in the direction of sheet conveyance A. The DC solenoid 8 moves the upstream side of the support member 7 in accordance with a drive signal output from a control board 8A. More specifically, the lever 9 is connected to the DC solenoid 8 and moves the support member 7 such that the belt 6 moves into or out of contact with the drum 3.

The sheet S is conveyed by the registration roller 10 with its leading edge coinciding with the leading edge of the toner image formed on the drum 3. When the leading edge of the sheet S approaches the drum 3, the control board 8A sends the drive signal to the DC solenoid 8. In response, the DC solenoid 8 moves the support member 7 toward the drum 3 via the lever 9 until the belt 6 contacts the drum 3. As a result, the nip W is formed between the drum 3 and the belt 6.

As shown in FIG. 5, the roller or driven roller 4, adjoining the drum 3, has its opposite ends 4A and 4B in the axial direction tapered in order to obviate the offset of the belt 6. While the driven roller 4 is formed of metal or similar conductive material, it is not electrically directly connected to any other conductive member because it simply supports the belt 6. The drive roller 5 is formed of, e.g., EPDM rubber, chloroprene rubber or silicone rubber in order to firmly grip the belt 6 when driven.

The bias roller 11 contacts the inner surface of the upper run of the belt 6 downstream of the driven roller 4 in the direction of movement of the belt 6. The bias roller 11 is connected to the high-tension power supply 12 and constitutes a contact electrode for applying a charge opposite in polarity to the toner to the belt 6.

The contact plate 13 contacts the inner surface of the lower run of the belt 6 in the vicinity of the driven roller 4 and reduces charge injection into the sheet S at the side upstream of the nip for image transfer, as will be described specifically later. Also, the contact plate 13 is used to sense a current flowing on the belt 6 as a feedback current, so that a current fed from the bias roller 11 can be controlled. For this purpose, an image transfer control board 14 is connected to the contact plate 13 and high-tension power supply 12. The image transfer control board 14 controls a current to be fed to the bias roller 11 in accordance with the current sensed by the contact plate 13.

As shown in FIG. 2, at the time of image transfer, the support member 7 is operated to move the belt 6 toward the drum 3 in synchronism with the conveyance of the sheet S by the registration roller 10. As a result, the nip W is formed between the drum 3 and the belt 6 and has a width of 4 mm to 8 mm in the direction of sheet conveyance A.

Figure 7:
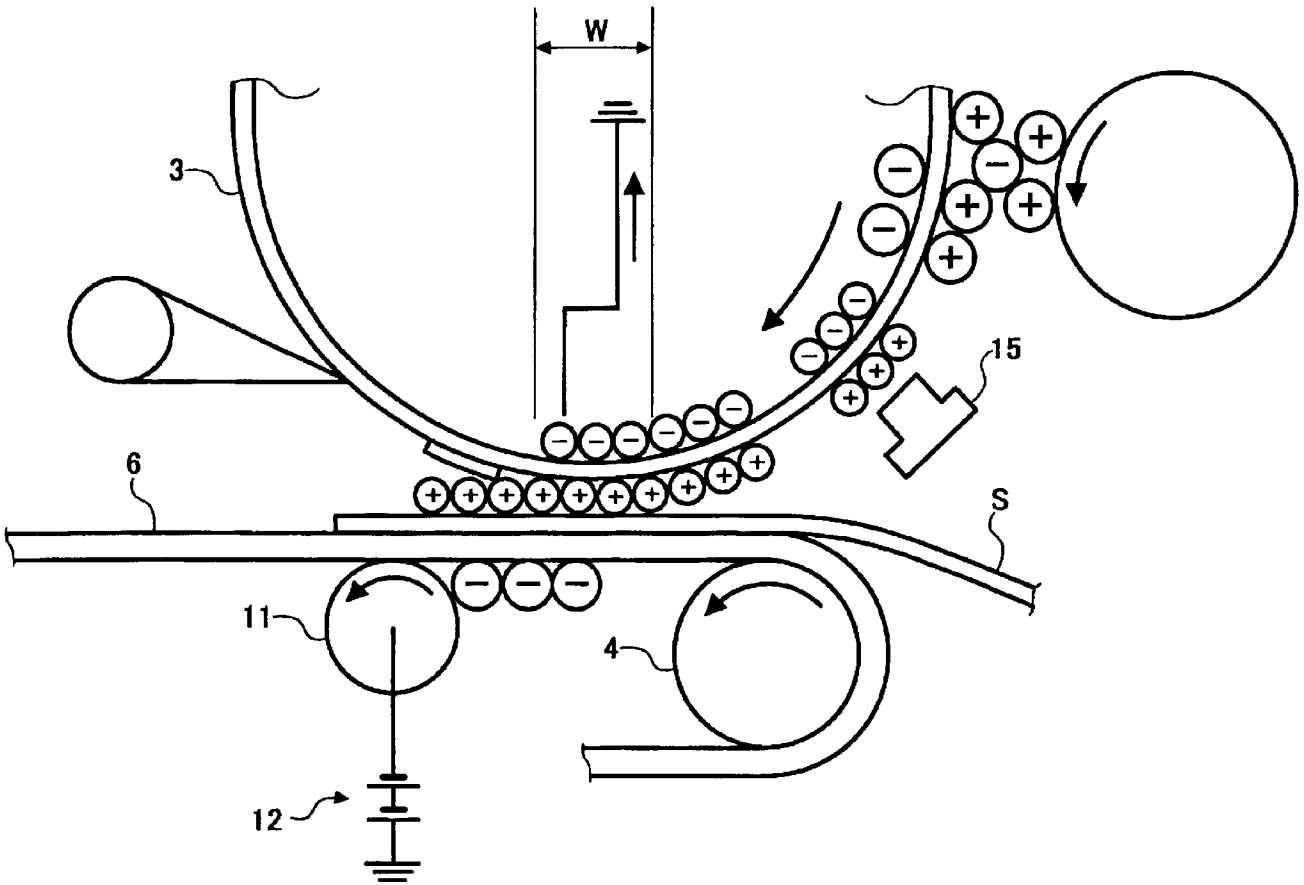
FIG. 7 demonstrates a developing and an image transferring step to be executed in the apparatus.

On the other hand, the drum 3 has its surface charged to −800 V. A latent image is formed on the charged surface of the drum 3 and then developed to become a toner image, as stated earlier. As shown in FIG. 7, the toner image, which is of positive polarity, is conveyed by the drum 3 to the nip W while being electrostatically deposited on the drum 3. The pretransfer lamp (PTL) 15 lowers the surface potential of the drum 3 at a position preceding the nip W. In FIG. 7, the size of a charge is represented by the size of a circle; the charge lowered by the PTL 15 is indicated by smaller circles than the original charge.

At the nip W shown in FIG. 1, the toner image is transferred from the drum 3 to the sheet S by the bias applied from the high-tension power supply 12 via the bias roller 11. In the illustrative embodiment, the bias is −1,000 V or below, preferably between −1,500 V and −10,000 V or more preferably between −2,000 V and −8,000 V. A bias above −1,000 V prevents image forming speed from being increased. Because the bias lying in the above desirable range produces a minimum of oxide gases, the life of the belt 6 is guaranteed even if it does not have the configuration stated earlier.

The bias for image transfer is variable by constant-current control to be described hereinafter. In FIGS. 1 and 2, assume that the high-tension power supply 12 outputs a current I1, and that the feedback current flowing from the contact plate 13 to ground via the belt 6 is I2. Then, the current 11 is controlled to satisfy a relation:

$$I1-I2=Iout \qquad \text{Eq. (1)}$$

where Iout is constant. By satisfying the above relation, it is possible to stabilize the surface potential Vp of the sheet S and thereby prevent image transfer efficiency from varying without regard to varying environmental conditions including temperature and humidity or the scattering of the belt 6 as to quality.

More specifically, regarding the current to flow to the drum 3 via the belt 6 and sheet S as Iout, the separation of the sheet S and image transfer are protected from the influence of a change in the flow of the current to the belt 6, which is ascribable to a decrease or an increase in the surface resistance Vp of the sheet S. In the illustrative embodiment, desirable image transfer was achieved with Iout of 35 $\mu$A±5 $\mu$A when conveying speed was 330 mm/sec and when effective bias roller length was 310 mm.

Now, when the toner image is transferred from the drum 3 to the sheet S, the sheet S is charged at the same time. Therefore, the sheet S can be electrostatically adhered to the belt 6 and separated from the drum 3 on the basis of a relation between the true charge of the belt 6 and the polarized charge deposited on the sheet S. The separation of the sheet S is enhanced by the flexibility of the sheet S itself.

Electrostatic adhesion, however, makes it difficult for the sheet S to part from the drum 3 when humidity is high, because a current easily flows to the sheet S in such an environment. In light of this, considering the relatively high resistance of the outer layer 6B of the belt 6, FIG. 6, the illustrative embodiment delays the transfer of the true charge to the sheet S at the nip W and locates the bias roller 11 downstream of the nip W in the direction of sheet conveyance A. The delayed transfer of the true charge from the belt 6 to the sheet S successfully avoids electrostatic adhesion between the sheet S and the drum 3.

The delayed transfer of the true charge refers to the fact that no charges deposit on the sheet S at the side upstream of the nip. The sheet S is therefore prevented from wrapping around the drum 3 and is surely separated from the drum 3.

It is also desirable to use a material whose resistance varies little against the varying environment.

The current Iout to flow to the drum 3 is not unconditionally determined, but may be reduced when the conveying speed is low or increased when the conveying speed is high or when the PTL 15 is absent.

The sheet S moved away from the nip W is conveyed by the belt 6 while electrostatically adhered thereto and then separated from the belt 6 by the curvature of the drive roller 5. To implement such separation, the drive roller 5 is provided with a diameter of 20 mm or below. Experiments showed that the drive roller 5 with the above diameter could separate fine-quality 45 K sheets (horizontal rigidity of 21 $cm^3$/100)

The sheet S separated from the belt 6 by the drive roller 5 is conveyed via a nip between a heat roller 17*a* and a press roller 17*b*, which constitutes the fixing unit 17. The heat roller 17*a* and press roller 17*b* cooperate to fix the toner image on the sheet S with heat and pressure.

After the separation of the sheet S from the belt 6, the DC solenoid 8 is turned off to release the belt 6 from the drum 3 via the lever 9 and support member 7. Subsequently, the belt cleaning unit 16 cleans the surface of the belt 6 with the cleaning blade 16A. More specifically, the cleaning blade 16A scrapes off toner transferred from the drum 3 to the belt 6 and toner flown around and deposited on the belt 6 as well as paper dust.

The belt 6 to be so rubbed by the cleaning blade 16A should preferably have its surface coated with a lubricant layer containing fluorocarbon resin having a small coefficient of friction, e.g., polyvinylidenefluoride or tetraethylene fluoride. The lubricant layer prevents a required torque from increasing due to an increase in frictional resistance or prevents the cleaning blade 16A from turning up. The toner and paper dust so removed from the belt 6 are conveyed by a screw 16B from the body 1A to a waste toner container not shown.

The belt 6 will be described more specifically hereinafter. The surface of the belt 6 is coated with the outer layer or lubricant layer 6B containing fluorocarbon resin, as stated above, and has therefore a small coefficient of friction. This kind of belt 6 can be cleaned in a stable manner. An intermediate layer may be formed between the outer layer 6B and inner layer 6A in order to promote the adhesion of the two layers 6B and 6A. For the intermediate layer, use may be made of halogenized polyolefin by way of example.

The outer layer 6B is provided with higher resistance than the inner layer 6A in order to obviate the defective separation of the sheet S from the drum 3 ascribable to the direct flow of the true charge to the sheet S in a humid environment. More specifically, for the inner layer 6A, use may be made of one or more of rubbers including polyisoprene rubber with a creep characteristic, polybudadien rubber, chloropren rubber, chlorosulfonated polyethylene, nitrile rubber, ethylene-propylene rubber or similar diene-containing synthetic rubber, butyl rubber, and acrylic rubber, urethane rubber, fluorocabon rubber, epichlorohydrin rubber, silicone rubber or similar non-diene-containing rubber. The filler stated earlier is dispersed in such rubber or a mixture of such rubbers. It is preferable to mix one or more of, among others, chloroprene rubber, ethylene-propylene rubber, silicone rubber and epichlorohydrin rubber. Chloroprene-containing rubber is excellent because it is highly flame-resistant and can have its conductivity easily controlled.

To adjust the conductivity of the inner layer 6A, a conductive filler, e.g., carbon black, acetylene black or similar carbon or the powder of titanium oxide, tin oxide, zinc oxide or similar metal oxide is mixed with rubber mentioned above.

The inner layer 6A should be 200 μm to 1,500 μm thick, preferably 300 μm to 1,000 μm thick or more preferably 400 μm to 700 μm thick. Thickness less than 200 μm makes the mechanical strength of the belt 6 short and is apt to cause the belt 6 to break or deform during repeated image formation. Thick ness above 1,500 μm makes the flexibility of the belt 6 short and increases the resistance of the belt 6.

The outer layer 6B should be 3 μm to 20 μm thick, preferably 5 μm to 15 μm thick. Thickness below 3 μm is apt to cause defects to appear in the outer layer 6B to thereby bring about defective cleaning. Thickness above 20 μm is apt to cause the outer layer 6B to crack due to the bend of the belt 6.

The rubber forming the inner surface of the belt 6 directly contacts the drive roller 5, bias roller 11, driven roller 4, and contact plate 13. The linear velocity of the drive roller 5 is substantially the same as the linear velocity of the drum 3. The illustrative embodiment is particularly advantageous when the linear velocity is as high as 250 mm/sec or above, preferably 270 mm/sec or above or more preferably 300 mm/sec to 600 mm/sec.

While the diameter of the driven roller 5 is open to choice, it should preferably be between 5 mm and 18 mm for reducing the size of the image transferring and sheet separating device 1. A diameter below 20 mm increases the bend of the belt 6 and therefore causes, when the belt 6 is deteriorated by oxide gases, the belt 6 to crack soon.

The image forming apparatus with the image transferring and sheet separating device 1 can preserve high image quality without the replacement of the belt 6 even when resolution is as high as 1,000 dpi (dots per inch) or above, preferably 1,200 dpi or above.

Specific examples of the illustrative embodiment will be described hereinafter.

EXAMPLE 1

The inner surface of a belt was implemented as a 500 μm thick rubber tube containing 80 parts by weight of chloroprene rubber, 20 parts by weight of ethylenepropylene rubber, 20 parts by weight of carbon black having a mean grain size of 85 nm, 20 parts by weight of talc having a mean grain size of 15 μm, 3 parts by weight of galvanizing agent and galvanization accelerator, and 11 parts by weight of process oil. An aqueous solution of tetraethylene fluoride resin and water-containing urethane resin was coated on the outer surface of the belt and then dried to form an about 10 μm thick lubricant layer. Five belts in total were prepared by such a procedure.

The five belts were respectively mounted to five image forming apparatuses each having the configuration shown in FIGS. 1 and 2 (resolution of 600 dpi) The belts each were stretched by 3% while in movement, compared to an unloaded condition. The drive roller had a diameter of 18 mm and driven to move the belt at a linear velocity of 330 mm/sec. The bias for image transfer was between −2,500 V and −5,000 V.

In any one of the image forming apparatuses, defects were not observed even in the 200,000th image. Also, no defects were observed on the surface of the belt. This was also true when additional 200,000 images were formed.

COMPARATIVE EXAMPLE 1

Example 1 was repeated except that talc had a mean grain size of 2 μm. Two belts were prepared and mounted to two the image forming apparatuses each having the configuration of FIGS. 1 and 2. A plurality of white spots appeared before the 120,000th image in both of the image forming apparatuses. Also, the belts each were locally slackened.

COMPARATIVE EXAMPLE 2

Example 1 was repeated except that talc had a mean grain size of 37 μm. Two belts were prepared and mounted to the image forming apparatuses each having the configuration of FIGS. 1 and 2. The belts each were cracked before the 30,000th image and made image formation impracticable.

EXAMPLE 2

Comparative Example 2 was repeated except that the belt was implemented as an 800 μm thick rubber tube. Two belts were respectively mounted to two image forming apparatuses each having the configuration of FIGS. 1 and 2. No defects were observed in the 100,000th image in both of the image forming apparatuses.

EXAMPLE 3

Example 1 was repeated except that dry silica with a mean grain size of 12 μm was substituted for talc. Three belts were prepared and respectively mounted three image forming apparatus each having the configuration of FIGS. 1 and 2. Each belt was stretched by 5%, compared to an unloaded condition. No defects were observed in the 200,000th image or on the belt surface. This was also true when additional 200,000 images were formed.

EXAMPLE 4

The inner layer of a belt was implemented as a 550 μm thick rubber tube containing 70 parts by weight of chloroprene rubber, 30 parts by weight of ethylenepropylene rubber, 20 parts by weight of carbon black with a mean grain size of 62 μm, 8 parts by weight of dry silica with a mean grain size of 12 μm, 4 parts by weight of aluminum hydroxide, 3 parts by weight of galvanizing agent and galvanization accelerator, and 8 parts by weight of process oil. An aqueous solution of tetraethylene fluoride and water-containing urethane resin was coated on the outer surface of the belt and then dried to form an about 12 μm thick lubricant layer. Ten belts in total were prepared by such a process.

Five image forming apparatuses identical with those of Example 3 were prepared except that resolution was 1,200 dpi. In any one of the five apparatuses, no defects were observed in the 400,000 image or on the belt surface. This was also true when additional 400,000 images were formed.

EXAMPLE 5

Five image forming apparatuses identical with those of Example 4 were prepared except that each belt was stretched by 3%, compared to an unloaded condition. In any one of the five apparatuses, no defects were observed in the 500,000th image or on the belt surface. This was also true when additional 500,000 images were formed.

As stated above, in the illustrative embodiment, the belt 6 contains a filler whose grain size is between 0.5% and 5.0% of the thickness of the belt 6, and thereby achieves desirable, uniform mechanical and electric characteristics. Even when image formation is repeated at high speed, high image quality is achievable without the replacement of the belt 6.

Further, use is made of chloroprene rubber which is flame-resisting and facilitates the adjustment of conductivity of the belt 6. This reduces irregularity in the conductivity of the belt 6 for thereby insuring high image quality.

An alternative embodiment of the present invention will be described hereinafter. Because the alternative embodiment is also practicable with the configuration described with reference to FIGS. 1 through 7, the following concentration will concentrate on features unique to the alternative embodiment.

To enhance durability of the belt 6 against ozone and oxide gases, the belt 6 should preferably contain an organic additive that physically isolates oxide gases and rubber. The organic additive, however, melts when subject to high temperature and critically degrades the mechanical and electric characteristics of the belt 6, resulting in defective image transfer and defective images. We found that part of the belt 6 was heated to temperature above the melting point of the organic additive due to temperature elevation ascribable to heat radiated from the fixing unit 17, heat ascribable to friction between the drive roller 5 and belt 6, and heat radiated during image transfer to due electric energy.

In light of the above, we rearranged a cooling mechanism around the belt 6 so as to lower the temperature of the belt 6 below the melting point of the organic additive mentioned above. We then found that even when the bias for image transfer was lowered to −1,000 V or below, high-quality images free from defects were achieved while the life of the belt 6 was extended.

More specifically, in the illustrative embodiment, the belt 6 contains an organic additive having an endothermic peak at 58° C. to 80° C., preferably 58° C. to 70° C. While the organic additive may be present in either one of the outer layer 6B and inner layer 6A, it should preferably be present in the inner layer 6A contacting the bias roller 11, which produces oxide gases.

When the endothermic peak of the organic additive is lower than 58° C., the additive melts at part of the belt 6 during image formation and is apt to make the mechanical and electric characteristics of the belt 6 irregular, resulting in defective images. When the endothermic peak is above 80° C., it is difficult to uniformly disperse the organic additive during kneading of rubber, which is the major component of the belt 6, also resulting in defective images ascribable to defective image transfer.

The endothermic peak mentioned above refers to one determined by a DSC (Differential Scanning Calorimeter) Many of organic additives are not a single substance, but are a mixture of compounds different in molecular weight from each other. Because the endothermic peak of a mixture is, in many cases, broad, not only the minimum point of a DSC curve but also a range of 10%, preferably 5%, of the minimum point should preferably be 58° to 70°.

While the organic additive may be wax, oil, plasticizer or the like, wax is most preferable in protecting the mechanical and electric characteristics of the belt 6 from oxide gases. The content of the organic additive should be between 0.5 wt % and 20 wt %, preferably between 1 wt % and 18 wt % or more preferably between 13 wt % and 15 wt %, of the entire belt 6. A content below 0.5 wt % brings about degradation of the belt 6 ascribable to oxide gates and thereby reduces the life of the belt. A content above 20 wt % prevents the organic additive to be uniformly; dispersed in the belt 6 and thereby makes the mechanical and electric characteristics irregular while lowering the parting ability.

A DSC is a convenient, reproducible implement for controlling the content and dispersion of the organic additive in the belt 6. A heat value at the endothermic peak between 58° and 80° should be 5 J/g to 4.0 J/g, preferably 10 J/g to 35 J/g or more preferably 15 J/g to 35 J/g. A heat value below 5 J/g obstructs the dispersion of the organic additive or reduces the amount of the same to thereby easily bring about the deterioration of the belt 6 ascribable to oxide gases. A heat value above 40 J/g makes the mechanical and electric characteristics irregular and lowers the parting ability for the same reason.

Again, rubber forming the inner surface of the belt 6 directly contacts the drive roller 5, bias roller 11, driven roller 4, and contact plate 13. The linear velocity of the drive roller 5 is substantially the same as the linear velocity of the drum 3. The illustrative embodiment is also particularly advantageous when the linear velocity is as high as 250 mm/sec or above, preferably 270 mm/sec or above or more preferably 300 mm/sec to 600 mm/sec.

In the illustrative embodiment the arrangement of the entire apparatus including the cooling mechanism must be controlled such that the highest temperature of the belt 6 is 55° C. or below, preferably room temperature to 53° C. or more preferably room temperature to 52° C. Temperature above 55° C. lowers the mechanical strength of the belt 6 and thereby bring about defective image transfer and defective images.

Specific examples of the illustrative embodiment will be described hereinafter.

EXAMPLE 1

The inner surface of a belt was implemented as a 0.5 mm thick rubber rube containing 70 parts by weight of polychloroprene rubber, 30 parts by weight of ethylenepropylene rubber, 20 parts by weight of acetylene black, 12 parts by weight of a filler (magnesium oxide and silica), 3 parts by weight of galvanizing agent and galvanization accelerator, and 15 parts by weight of wax. An aqueous solution of tetraethylene fluoride resin and water-containing urethane resin was coated on the outer surface of the belt and then dried to form an about 10 $\mu$m thick lubricant layer. Ten belts in total were prepared by such a procedure.

Wax had an endothermic peak at 46.8° C., as measured by a DSC available from SEIKO ELECTRONICS at the elevation rate of 10° C./min. The belts each had an endothermic peak at 46.8° C. while the heat value at the endothermic peak of 58° C. to 80° C. was 18.3 J/g.

The ten belts were mounted to five image forming apparatuses each having the configuration shown in FIG. 1. The drive roller had a diameter of 18 mm and driven to move the belt at a linear velocity of 330 mm/sec. The bias for image transfer was between −2,500 V and −5,000 V. Each apparatus was formed with a vent hole around the image transferring and sheet separating device for thereby controlling the maximum temperature of the belt to 51° C. or below.

In any one of the image forming apparatuses, defects, were not observed even in the 200,000th image. Also, no defects were observed on the surface of the belt. This was also true when additional 200,000 images were formed.

COMPARATIVE EXAMPLE 1

The other five belts prepared in Example 1 were used to construct image forming apparatuses each having the configuration of FIG. 5. After the vent hole around the image transferring and sheet separating device of each apparatus was fully filled up with tapes, 20,000 images were formed. Just after the output of the 20,000th image, the maximum temperature of each belt was locally as high as 56° C. to 57° C. Two of the five apparatuses failed to form images due to the breakage of the belts before the 20,000th image was output. Noticeable defects were observed in the 200,000th image output by the other three apparatuses while the belts were cracked at three to eight positions.

EXAMPLES 2 THROUGH 4

Example 1 was repeated to prepare five belts except that the wax content was 2 parts by weight, 5 parts by weight and 27 parts by weight. 100,000 images were output in the same manner as Example 1. No defects were observed in the images output by the five apparatuses to which the above wax contents were assigned. Also, no defects were observed on the belt surface.

COMPARATIVE EXAMPLE 2

Example 1 was repeated to prepare five belts except that the wax content was zero part by weight. 100,000 images were output in the same manner as Example 1. Defects were observed in images output by four of the five apparatuses. The belts of such four apparatuses each were cracked at one to four positions.

EXAMPLE 5

Example 1 was repeated to prepare five belts except that a plasticizer having an endothermic peak at 60° C. was substituted for wax. 300,000 images were output in the same manner as Example 1. No defects were observed in the images output by the five apparatuses. Also, no defects were observed on the belt surface.

As stated above, in the illustrative embodiment, the belt 6 is used at temperature that does not deteriorate the resistance of the belt 6 to oxide gases or the mechanical and electric characteristics of the same. Therefore, the illustrative embodiment achieves high image quality and high reliability even after repeated image formation. Chloroprene rubber, which is flame-resisting and allows the conductivity of the belt to be easily controlled, reduces irregularity in conductivity and insures high image quality. Further, the illustrative embodiment reduces the size of the image forming apparatus.

Various modifications will become possible for those skilled in the art after receiving the teachings of the present disclosure without departing from the scope thereof.

What is claimed is:

1. In an image transferring and sheet separating device comprising a belt facing an image carrier and conveying a recording medium via a nip between said belt and said image carrier to thereby transfer a toner image formed on said image carrier to said recording medium with a bias and then separate said recording medium from said image carrier, said belt contains a filler having a grain size of 0.5 % to 5 % of a thickness of said belt, and said belt is driven with a circumferential length 1% to 7% greater than a circumferential length in an unloaded condition.

2. The device as claimed in claim 1, wherein said belt is 200 μm to 1,000 μm thick.

3. The device as claimed in claim 1, wherein said belt contains polychloroprene rubber.

4. The device as claimed in claim 1, wherein a filler content of said belt is between 5 wt % and 25 wt % of an entirety of said belt.

5. The device as claimed in claim 1, wherein the filler of said belt comprises a silicon-containing compound.

6. The device as claimed in claim 5, wherein the silicon-containing compound comprises synthetic silicic acid.

7. The device as claimed in claim 1, wherein the filler of the belt comprises carbon.

8. The device as claimed in claim 7, wherein the carbon has a mean grain size of 0.5% or less of a thickness of said belt.

9. The device as claimed in claim 7, wherein a content of the carbon is 5 wt % to 25 wt % of an entirety of said belt.

10. In an image forming apparatus comprising an image transferring and sheet separating device including a belt facing an image carrier and conveying a recording medium via a nip between said belt and said image carrier to thereby transfer a toner image formed on said image carrier to said recording medium with a bias and then separate said recording medium from said image carrier, said belt contains a filler having a grain size of 0.5% to 5% of a thickness of said belt, and said belt is driven with a circumferential length 1% to 7% greater than a circumferential length in an unloaded condition.

11. The apparatus as claimed in claim 10, wherein said apparatus has a resolution of 1,000 dpi or above.

12. In an image transferring and sheet separating device including a belt facing an image carrier and conveying a recording medium via a nip between said belt and said image carrier to thereby transfer a toner image formed on said image carrier to said recording medium with a bias and then separate said recording medium from said image carrier, a maximum temperature which said belt reaches is 55° C. or below, and said belt contains an organic additive having an endothermic peak at 58° C. to 80° C.

13. The device as claimed in claim 12, wherein the organic additive comprises wax.

14. The device as claimed in claim 12, wherein a content of the organic additive is 0.5 wt % to 20 wt % of an entirety of said belt.

15. The device as claimed in claim 12, wherein a heat value of said belt at 58° C. to 80° C., as measured by a differential scanning calorimeter, is 5 J/g to 40 J/g.

16. The device as claimed in claim 12, wherein said belt contains polychloroprene rubber.

17. The device as claimed in claim 12, wherein said belt is bent with a radius of curvature of 10 mm or below.

18. In an image forming apparatus comprising an image transferring and sheet separating device including a belt facing an image carrier and conveying a recording medium via a nip between said belt and said image carrier to thereby transfer a toner image formed on said image carrier to said recording medium with a bias and then separate said recording medium from said image carrier, a maximum temperature which said belt reaches is 55° C. or below, and said belt contains an organic additive having an endothermic peak at 58° C. to 80° C.

* * * * *